US007265608B1

(12) United States Patent
Lu et al.

(10) Patent No.: US 7,265,608 B1
(45) Date of Patent: Sep. 4, 2007

(54) CURRENT MODE TRIMMING APPARATUS

(75) Inventors: Chun-Te Lu, Taipei (TW); Chen-Ting Ko, Sijhih (TW)

(73) Assignee: Faraday Technology Corp., Hsin-Chu (TW)

( * ) Notice: Subject to any disclaimer, the term of this patent is extended or adjusted under 35 U.S.C. 154(b) by 0 days.

(21) Appl. No.: 11/403,002

(22) Filed: Apr. 11, 2006

(51) Int. Cl.
*G05F 1/10* (2006.01)

(52) U.S. Cl. ..... 327/543; 327/538; 323/313

(58) Field of Classification Search ..... None
See application file for complete search history.

(56) References Cited

U.S. PATENT DOCUMENTS 4,349,777 A * 9/1982 Mitamura ..... 323/226
5,446,407 A * 8/1995 Yamamoto ..... 327/525
5,493,205 A * 2/1996 Gorecki ..... 323/315
6,608,472 B1 * 8/2003 Kutz et al. ..... 323/313
7,218,168 B1 * 5/2007 Rahman ..... 327/540

* cited by examiner

*Primary Examiner*—Kenneth B. Wells
*Assistant Examiner*—An T. Luu
(74) *Attorney, Agent, or Firm*—Winston Hsu

(57) ABSTRACT

A current mode trimming apparatus for trimming a desired current is provided. The trimming apparatus includes a first transistor, a first resistor, an operational amplifier, a first controlled current source, and a second controlled current source. The first and second controlled current sources adjust the output current thereof respectively in accordance with the trimming data. The desired current passing through the first transistor is trimmed in a manner of increasing or decreasing current. Therefore, the invention can linearly increase or decrease the desired current by controlling the controlled current sources with the trimming data to achieve the goal of trimming.

10 Claims, 8 Drawing Sheets

CURRENT MODE TRIMMING APPARATUS

BACKGROUND OF THE INVENTION

1. Field of Invention

The present invention relates to a trimming apparatus, and more particularly, to a current mode trimming apparatus.

2. Description of Related Art

When manufacturing Integrated Circuits (ICs), electrical characteristics vary in the process of manufacturing for various reasons. This variance in electrical characteristics results in many uncertainties in circuit design. Therefore, in order to reduce the factor of electrical variance, besides continuously pursuing the development of the procedure for manufacturing ICs, another remedy for adjusting varied electrical characteristics is trimming.

Conventional trimming technologies comprise two approaches, i.e. poly fuse and laser cut. In poly fuse, a trimming circuit is coupled to the main IC circuit, and poly-silicon is used in the trimming circuit for connection. When the electrical characteristics of the IC are to be adjusted, the desired value of the electrical characteristics of the IC can be obtained by simply increasing the current to cut the poly-silicon in the trimming circuit and change the circuit structure. In laser cut, the method is similar, except that the poly-silicon is displaced by metal, and the metal is cut by means of a laser instead of current, which can also change the electrical characteristics of the IC.

Referring to FIG. 1A, it shows a block diagram of a conventional trimming circuit. An operational amplifier 110 has an positive input end for receiving a reference voltage VREF, and a negative input end and an output end respectively electrically connected to a drain and a gate of an N-type transistor 120. A source of the transistor 120 is electrically connected to a system voltage VCCA. Resistors 130, 141, 142, and 143 are connected in series between the drain of the N-type transistor 120 and a ground voltage GND. Resistors 141, 142, and 143 respectively have the resistance of 4RΩ, 2RΩ, and RΩ. Pads 151~153 and fuses 161~163 are also connected in series with each other between the drain of the N-type transistor 120 and the ground voltage GND. The pads 152 and 153 are further electrically connected to both ends of the resistor 142 respectively. Through the pads 151~153, any fuse of the fuses 161~163 is selected to be cut, thereby changing the connection state of the fuses 161~163. By determining the connection state of the fuses 161~163, the total resistance $R_{tot}$ of the resistor strings 130, 141, 142, and 143 can thus be determined. Since desired current $I_{tot}$=VREF/$R_{tot}$, the desired current $I_{tot}$ passing through the transistor 120 can be trimmed by trimming the total resistance $R_{tot}$ of the resistor strings 130, 141, 142, and 143.

FIG. 1B shows the relation between the total resistance $R_{tot}$ and the desired current $I_{tot}$ of the conventional trimming circuit in FIG. 1A. Referring to FIG. 1A and FIG. 1B together, the transverse axis of FIG. 1B represents the total resistance $R_{tot}$ of resistor strings 130, 141, 142, and 143, while the longitudinal axis thereof represents the desired current $I_{tot}$ passing through the transistor 120. It can be clearly seen from FIG. 1B that the trimming result of the conventional trimming circuit in FIG. 1A is not linear, thus the accuracy of the trimming is affected. Furthermore, all fuses 161~163 are not cut before trimming, and the total resistance $R_{tot}$ of the resistor strings is at a minimum at this time, thus the conventional trimming circuit must start trimming from the maximum desired current $I_{tot}$. Therefore, when the desired current $I_{tot}$ is smaller than the predetermined current, the conventional trimming circuit will become inapplicable since it cannot increase the desired current $I_{tot}$.

SUMMARY OF THE INVENTION

An object of the present invention is to provide a current mode trimming apparatus for obtaining a linear trimming result and increasing/decreasing the trimming result as desired.

Based on the above and other objects, the present invention provides a current mode trimming apparatus for trimming a desired current. The trimming apparatus includes a first transistor, a first resistor, an operational amplifier, a first controlled current source, and a second controlled current source. The first resistor and the first transistor are connected in series between a first voltage and a second voltage. The current passing through the first transistor is the desired current. The operational amplifier has a first input end for receiving a reference voltage, a second input end electrically connected to a common node between the first resistor and the first transistor, and an output end electrically connected to a gate of the first transistor. The first controlled current source is electrically connected between the common node and the first voltage for providing a first current, and the first current is adjusted in accordance with a received first trimming data thereof. The second controlled current source is electrically connected between the common node and the second voltage for providing a second current, and the second current is adjusted in accordance with a received second trimming data thereof.

According to the current mode trimming apparatus described in the preferred embodiment of the present invention, the first controlled current source includes n current sources $CS\mathbf{1}_i$ and n switches $SW\mathbf{1}_i$. The $CS\mathbf{1}_i$ represents the ith current source. The $SW\mathbf{1}_i$ represents the ith switch, where i is an integer greater than or equal to 0 but smaller than n, and n is an integer greater than 0. The current sources $CS\mathbf{1}_i$ provide currents of $2^i$I A, wherein I is a real number. The switches $SW\mathbf{1}_i$ and the current sources $CS\mathbf{1}_i$ are connected in series between the first voltage and the common node. The switches $SW\mathbf{1}_i$ determine the on/off states by themselves respectively in accordance with the first trimming data.

According to the current mode trimming apparatus described in the preferred embodiment of the present invention, the second controlled current source comprises n current sources $CS\mathbf{2}_i$ and n switches $SW\mathbf{2}_i$. The $CS\mathbf{2}_i$ represents the ith current source. The $SW\mathbf{2}_i$ represents the ith switch. The current sources $CS\mathbf{2}_i$ provide currents of $2^i$A. The switches $SW\mathbf{2}_i$ and the current sources $CS\mathbf{2}_i$ are connected in series between the second voltage and the common node for determining the on/off states by themselves respectively in accordance with the second trimming data.

The present invention changes the desired current in the manner of increasing/decreasing the current, i.e. controlling the controlled current sources with the trimming data. Therefore, the desired current can be linearly increased or decreased in accordance with the control of the trimming data to achieve the goal of trimming.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
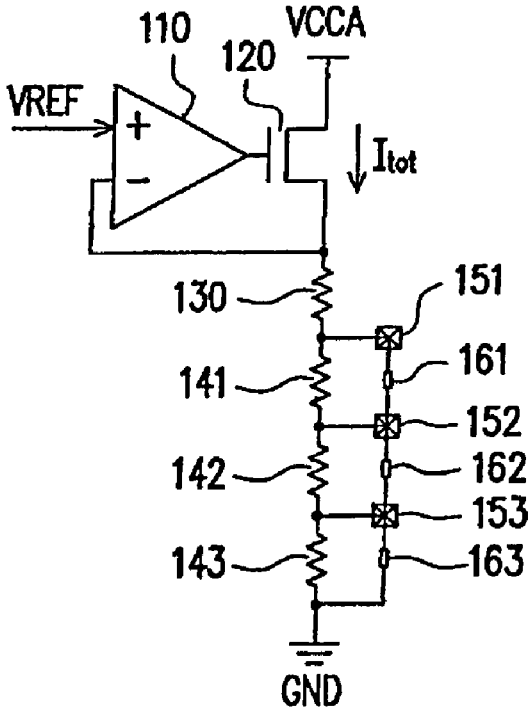
FIG. 1A (PRIOR ART)
FIG. 1A shows a block diagram of a conventional trimming circuit.
Figure 1B:
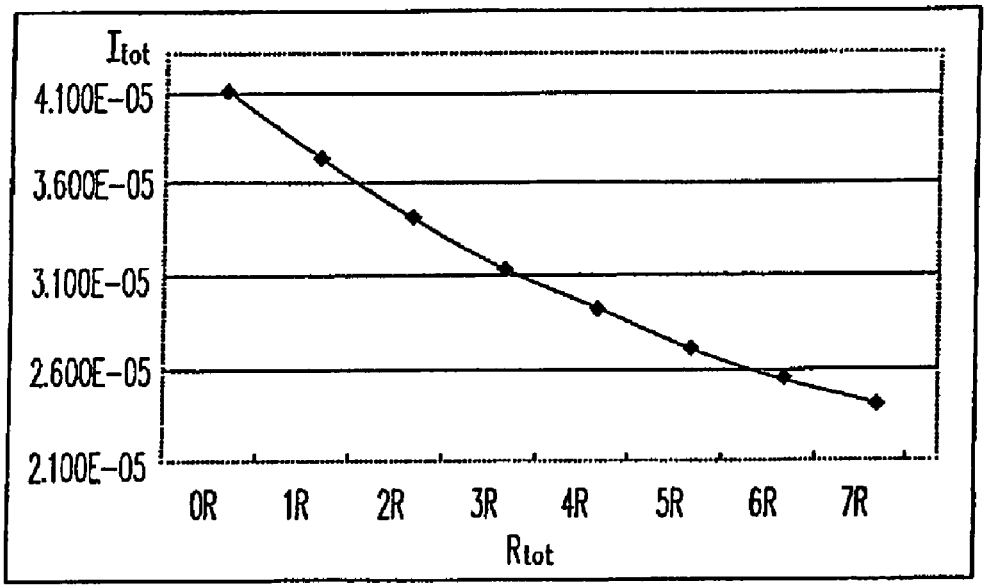
FIG. 1B (PRIOR ART)
FIG. 1B shows the relation between the total resistance $R_{tot}$ and the desired current $I_{tot}$ of a conventional trimming circuit in FIG. 1A.
Figure 2:
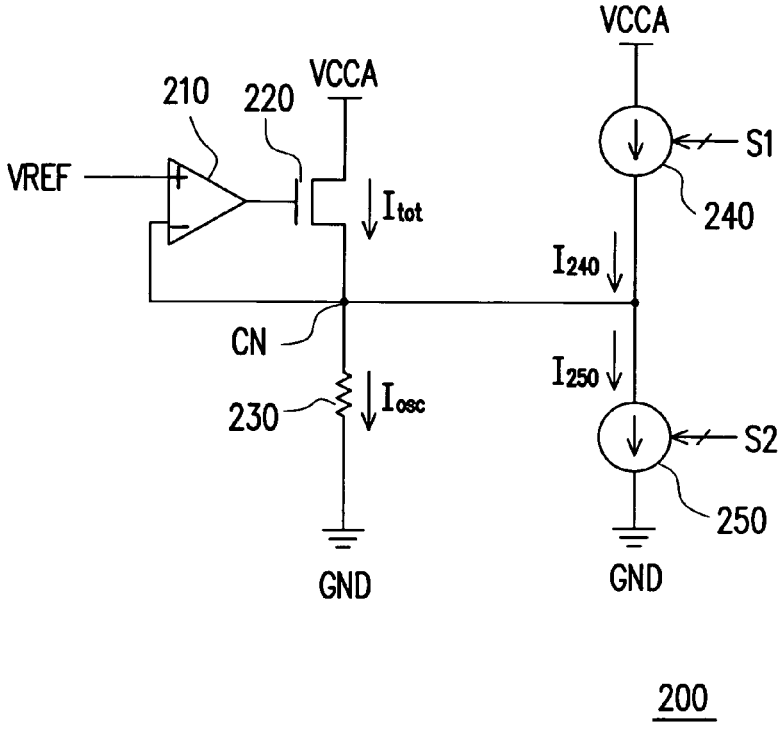
FIG. 2 shows a current mode trimming apparatus according to an embodiment of the present invention.

FIG. 2 shows a current mode trimming apparatus according to the embodiment of the present invention. Referring to FIG. 2, a trimming apparatus 200 includes an operational amplifier 210, a first transistor 220, a first resistor 230, a first controlled current source 240, and a second controlled current source 250. The transistor 220 and the resistor 230 are connected in series between the first voltage and the second voltage. In the present embodiment, the transistor 220 is, for example, an N-type transistor, the first voltage is, for example, a system voltage VCCA. The second voltage is a ground voltage GND. The operational amplifier 210 has a first input end (positive input end herein) for receiving a reference voltage VREF, a second input end (negative input end herein) electrically connected to a common node CN between the resistor 230 and the transistor 220, and has an output end electrically connected to a gate of the transistor 220. Assuming that the resistance of the resistor 230 is $R_{230}$, and the current passing through the resistor 230 is $I_{osc}$, $I_{osc}=VREF/R_{230}$.

The controlled current source 240 is electrically connected between the common node CN and the system voltage VCCA, and the controlled current source 250 is electrically connected between the common node CN and the ground voltage GND. The controlled current sources 240 and 250 provide a first current $I_{240}$ and a second current $I_{250}$ in accordance with a first trimming data S1 and a second trimming data S2 respectively. Since the desired current $I_{tot}$ passing through the transistor 220 equals to $I_{osc}+I_{250}-I_{240}$, the amount of the current $I_{250}$ and $I_{240}$ can be determined through controlling the controlled current sources 240 and 250 by trimming data S1 and S2 to achieve the object of trimming the desired current $I_{tot}$.

For example, the current $I_{250}$ and $I_{240}$ can be 0 A (or $I_{250}=I_{240}$) through controlling the controlled current sources 240 and 250 by trimming data S1 and S2. At this time, the desired current $I_{tot}=I_{osc}$ is used as an initial value of the trimming apparatus 200. When the desired current $I_{tot}$ is to be trimmed to a small value, the current $I_{240}$ is increased through controlling the controlled current sources 240 by the trimming data S1. On the contrary, if the desired current $I_{tot}$ is to be trimmed to a large value, the current $I_{250}$ is increased through controlling the controlled current sources 250 by the trimming data S2.

Figure 3:
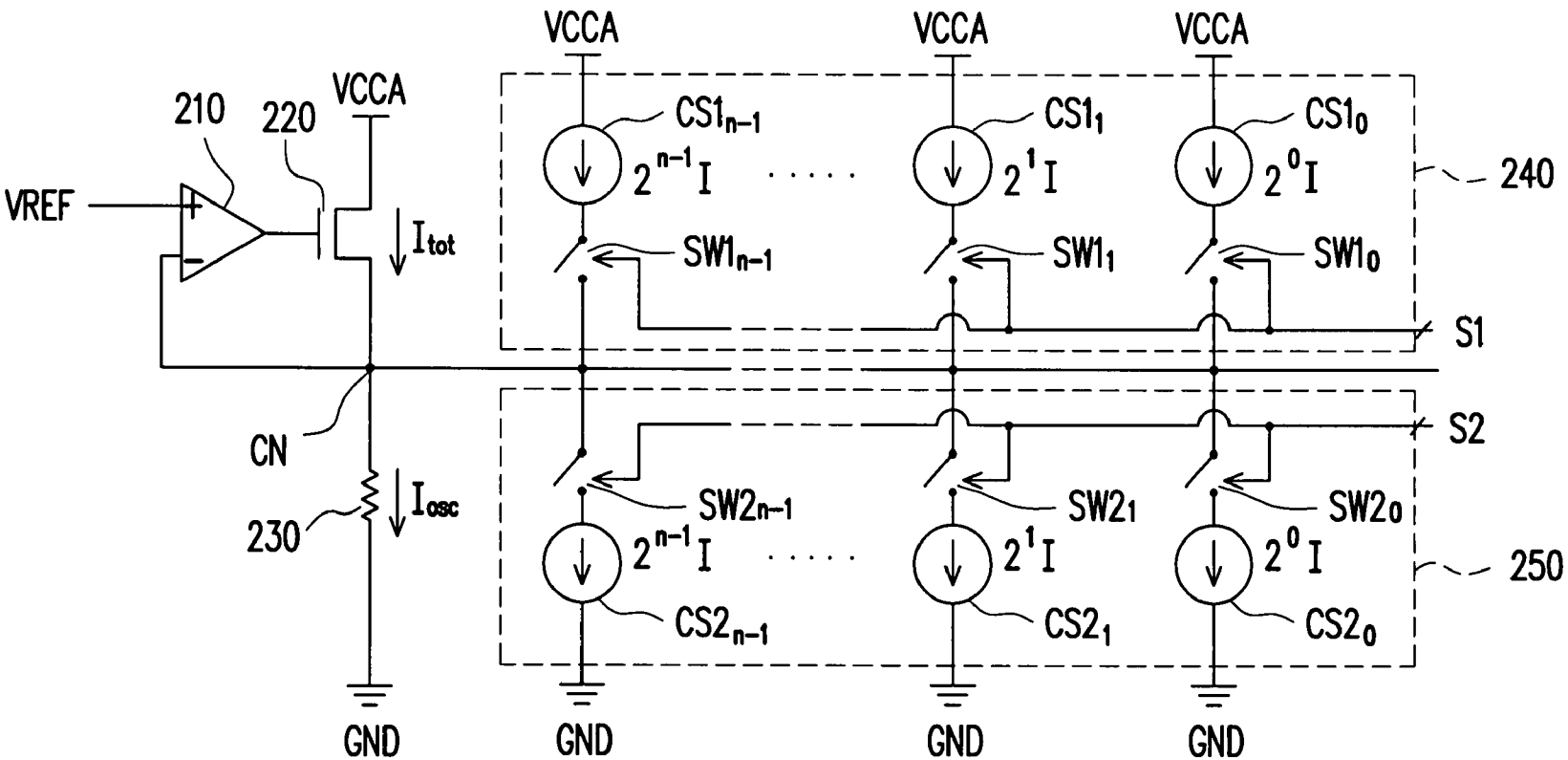
FIG. 3 shows an exemplary circuit diagram of a trimming apparatus according to the present invention.

The controlled current sources 240 and 250 can be implemented referring to FIG. 3. FIG. 3 shows an exemplary circuit diagram of a trimming apparatus according to the present invention. In FIG. 3, the operational amplifier 210, the first transistor 220, the first resistor 230, the first controlled current source 240, and the second controlled current source 250 are the same as that in FIG. 2, which will not be described herein. In the present embodiment, the controlled current sources 240 includes n current sources $CS1_0$~$CS1_{n-1}$ and n switches $SW1_0$~$SW1_{n-1}$. And the controlled current sources 250 includes n current sources $CS2_0$~$CS2_{n-1}$ and n switches $SW2_0$~$SW2_{n-1}$.

The current sources $CS1_i$ respectively provide currents of $2^iI$ Ampere, wherein i is an integer greater than or equal to 0 but smaller than n, n is an integer greater than 0, and I is a real number. The switches $SW1_i$ and the current sources $CS1_i$ are connected in series between the system voltage VCCA and the common node CN. The switches $SW2_i$ and the current sources $CS2_i$ are connected in series between the voltage GND and the common node CN. The switches $SW1_i$ and switches $SW2_i$ respectively determine the on/off states by themselves in accordance with the first trimming data S1 and the second trimming data S2.

Figure 4A:
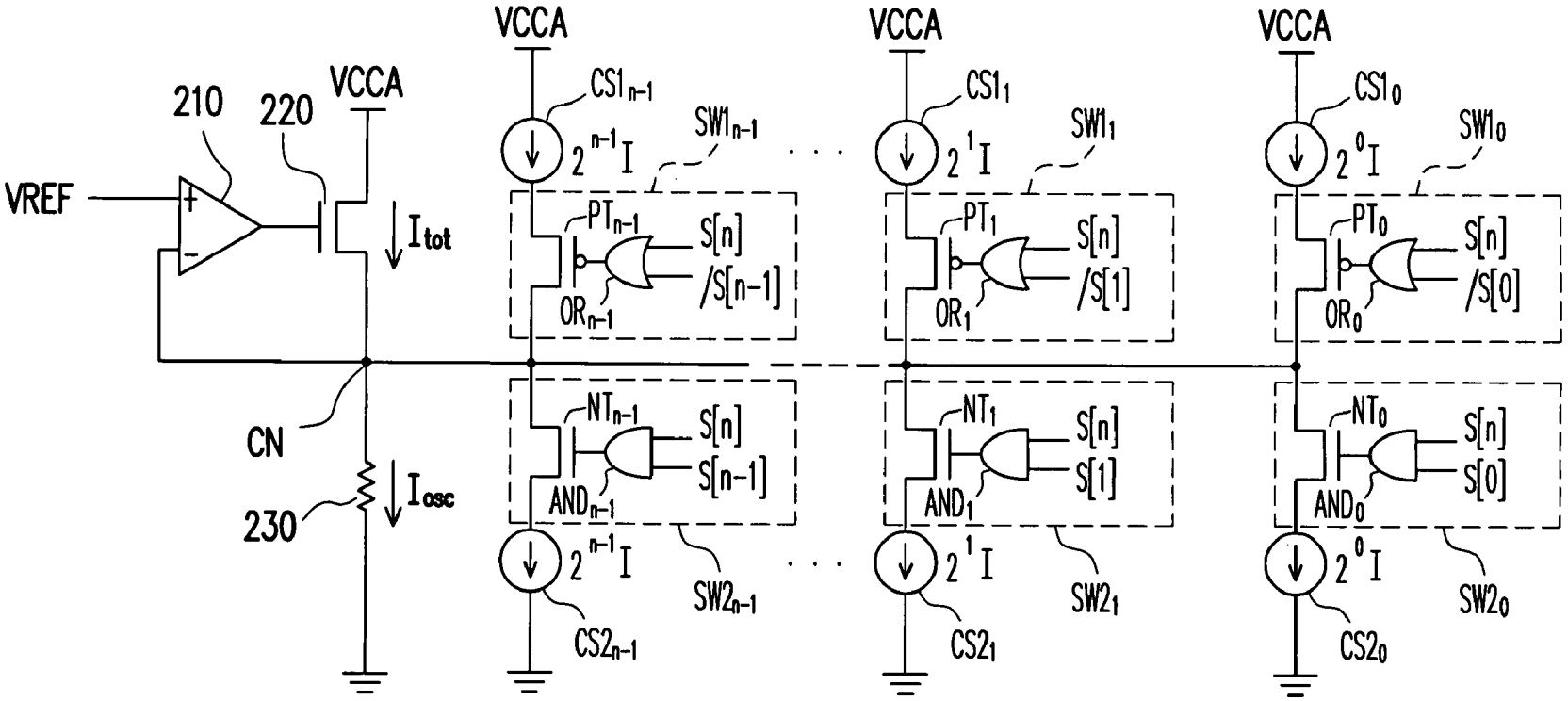
FIG. 4A shows another exemplary circuit diagram of a trimming apparatus according to the present invention.

FIG. 4A shows another exemplary circuit diagram of a trimming apparatus according to the present invention. In FIG. 4A, the operational amplifier 210, the first transistor 220, the first resistor 230, the current sources $CS1_0$~$CS1_{n-1}$ and $CS2_0$~$CS2_{n-1}$, and the switches $SW1_0$~$SW1_{n-1}$ and $SW2_0$~$SW2_{n-1}$ are the same as that in FIG. 3, which will not be described herein. In the present embodiment, the first trimming data S1 and the second trimming data S2 respectively have an n+1th bit. That is, the first trimming data S1 has trimming data bits S[n], /S[n−1], . . . , /S[1], /S[0], and the second trimming data S2 has trimming data bits S[n], S[n−1], . . . , S[1], S[0], wherein /S[n−1]~/S[0] are inverted data of the S[n−1]~S[0].

Figure 4B:
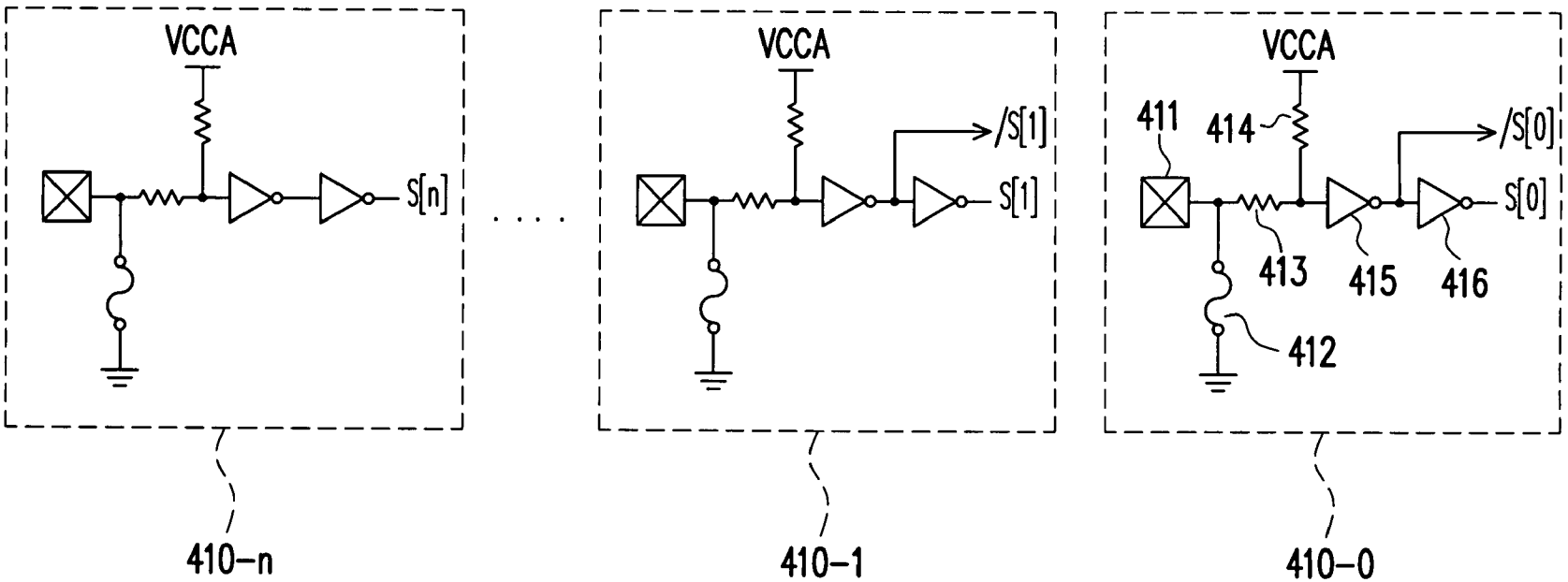
FIG. 4B shows an exemplary circuit diagram of a fuse unit according to the present invention.

FIG. 4B shows an exemplary circuit diagram of a fuse unit 410-0, 410-1, . . . , **410-*n* according to the present invention. Referring to FIG. 4A and FIG. 4B together, in the present embodiment, the trimming data bits S[n], /S[n−1]~/S[0] and S[n−1]S[0] are provided by the fuse units 410-0, 410-1, . . . , 410-*n*. The fuse units 410-0~410-*n* output the first trimming data S1 and the second trimming data S2 in accordance with the states of fuses therein. Herein below, only the fuse unit 410-0 is taken as an example, and other fuse units 410-1~410-*n* can be implemented referring to the fuse unit 410-0**.

The fuse unit 410-0 includes a pad 411, a second resistor 414, a third resistor 413, a fuse 412, a first NOT gate 415, and a second NOT gate 416. The resistor 414 has a first end electrically connected to the system voltage VCCA. The resistor 413 has a first end electrically connected to a second end of the resistor 141, and a second end electrically connected to the pad 411. The fuse 412 has a first end electrically connected to a second end of the resistor 413, and a second end electrically connected to the ground voltage GND. The NOT gate 415 has an input end electrically connected to a second end of the resistor 414, and an output end outputting the trimming data bit /S[0]. The NOT gate 416 has an input end electrically connected to the output end of the NOT gate 415, and an output end outputting the trimming data bit S[0].

When the fuse 412 is not cut, the trimming data bit S[0] is logic 0, and the trimming data bit /S[0] is logic 1. When the fuse 412 is to be cut, a cutting current can be provided through the pad 411, and the state of the fuse is changed by passing a great amount of cutting current through the fuse 412. Therefore, when the fuse 412 is broken, by increasing the resistor 414, the trimming data bit S[0] is converted into logic 1, and the trimming data bit /S[0] is logic 0.

Hereinafter, only switches $SW1_0$ and $SW2_0$ are taken as an example, and other switches $SW1_1$~$SW1_{n-1}$ can be implemented referring to the switch $SW1_0$, which other switches $SW2_1$~$SW2_{n-1}$ can be implemented referring to the switch $SW2_0$. The switch $SW1_0$ includes a P-type transistor $PT_0$ and an OR gate $OR_0$. The transistor $PT_0$ has a source and drain respectively electrically connected to the current source $CS1_0$ and the common node CN. The OR gate $OR_0$ has a first input end and second input end respectively receiving the trimming data bits S[n] and /S[0], and an output end electrically connected to a gate of the transistor $PT_0$. The switch $SW2_0$ includes an N-type transistor $NT_0$ and an AND gate $AND_0$. The transistor $NT_0$ has a source and drain respectively electrically connected to the current source $CS2_0$ and the common node CN. The AND gate $AND_0$ has a first input end and second input end for respectively receiving the trimming data bits S[n] and S[0], and an output end electrically connected to a gate of the transistor $NT_0$.

Figure 5A:
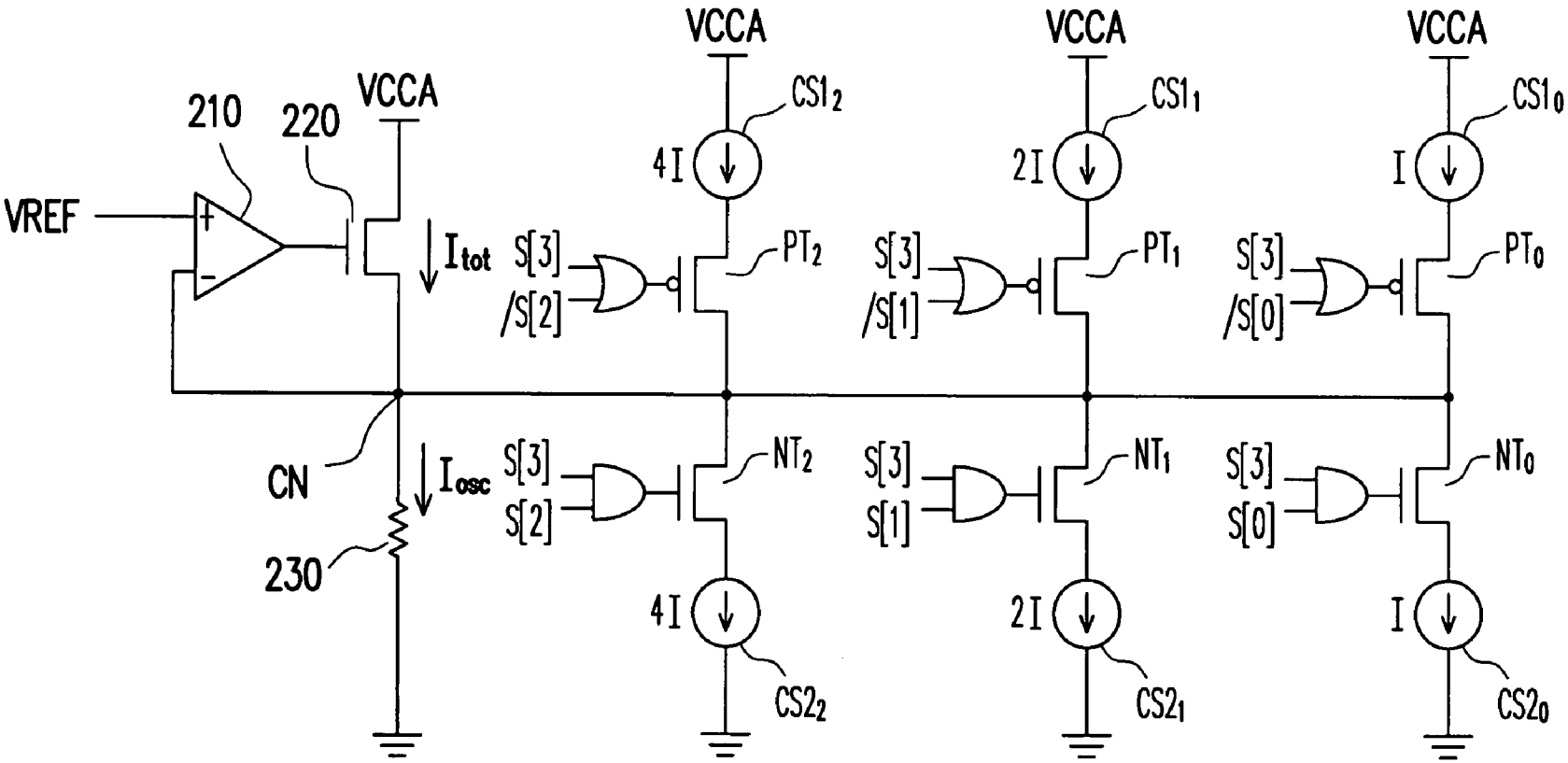
FIG. 5A shows a special case of the trimming apparatus of FIG. 4A according to the present invention.
Figure 5B:
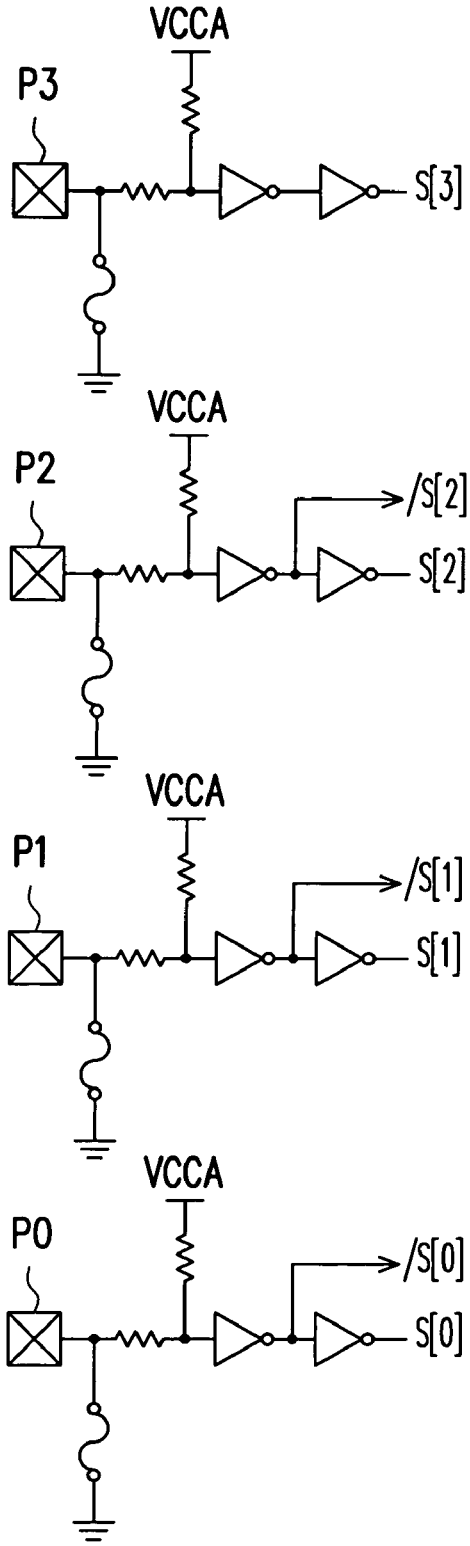
FIG. 5B shows a special case of the fuse unit of FIG. 4B according to the present invention.
Figure 6:
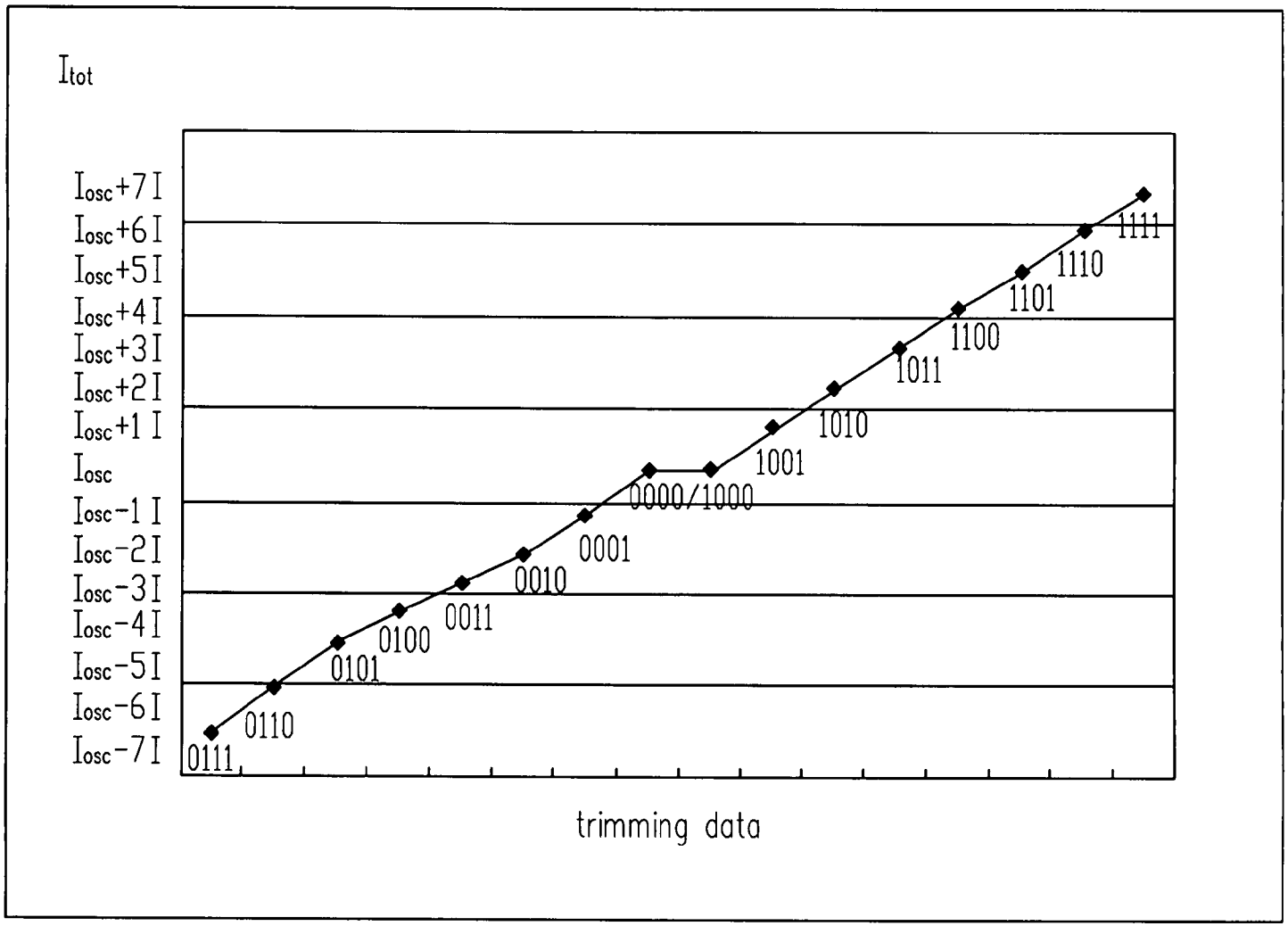
FIG. 6 shows the relation between the trimming data applied to the pads P3~P0 and the desired current $I_{tot}$ in FIG. 5A and FIG. 5B according to the embodiments of the present invention.

In order to clearly illustrate the present invention, the embodiment of the present invention is described in detail by taking n=3 as an example. FIG. 5A shows a special case of the trimming apparatus in FIG. 4A. FIG. 5B shows a special case of the fuse unit in FIG. 4B. Referring to FIG. 5A and FIG. 5B together, when trimming data with different logic values are applied to the pads P3~P0, the desired current $I_{tot}$ can be trimmed to the corresponding current values. Table 1 shows a real value table of FIG. 5A and FIG. 5B according to the embodiments of the present invention. FIG. 6 shows the relation between the trimming data applied to the pads P3~$P_0$ and the desired current $I_{tot}$ in FIG. 5A and FIG. 5B according to embodiments of the present invention. It can be seen from FIG. 6 that the relation between the trimming data and desired current $I_{tot}$ is linear.

TABLE 1

Real Value Table of FIG.5A and FIG.5B

| P3 | P2 | P1 | P0 | $PT_2$ | $PT_1$ | $PT_0$ | $NT_2$ | $NT_1$ | $NT_0$ | $I_{tot}$ |
|---|---|---|---|---|---|---|---|---|---|---|
| 0 | 0 | 0 | 0 | Off | off | off | off | off | off | $I_{osc}$ |
| 0 | 0 | 0 | 1 | Off | off | on | off | off | off | $I_{osc} - I$ |
| 0 | 0 | 1 | 0 | Off | on | off | off | off | off | $I_{osc} - 2I$ |
| 0 | 0 | 1 | 1 | off | on | on | off | off | off | $I_{osc} - 3I$ |
| 0 | 1 | 0 | 0 | on | off | off | off | off | off | $I_{osc} - 4I$ |
| 0 | 1 | 0 | 1 | on | off | on | off | off | off | $I_{osc} - 5I$ |
| 0 | 1 | 1 | 0 | on | on | off | off | off | off | $I_{osc} - 6I$ |
| 0 | 1 | 1 | 1 | on | on | on | off | off | off | $I_{osc} - 7I$ |
| 1 | 0 | 0 | 0 | off | off | off | off | off | off | $I_{osc}$ |
| 1 | 0 | 0 | 1 | off | off | off | off | off | on | $I_{osc} + I$ |
| 1 | 0 | 1 | 0 | off | off | off | off | on | off | $I_{osc} + 2I$ |
| 1 | 0 | 1 | 1 | off | off | off | off | on | on | $I_{osc} + 3I$ |
| 1 | 1 | 0 | 0 | off | off | off | on | off | off | $I_{osc} + 4I$ |
| 1 | 1 | 0 | 1 | off | off | off | on | off | on | $I_{osc} + 5I$ |
| 1 | 1 | 1 | 0 | off | off | off | on | on | off | $I_{osc} + 6I$ |
| 1 | 1 | 1 | 1 | off | off | off | on | on | on | $I_{osc} + 7I$ |

To sum up, by determining the states of the fuses in the fuse unit, or by setting the trimming data directly through the pads, the first controlled current source and the second controlled current source are controlled to provide the first current and the second current, thereby achieving the goal of trimming the desired current $I_{tot}$. The present invention changes the desired current in manner of increasing/decreasing the current, i.e. controlling the controlled current sources with the trimming data. Therefore, the desired current can be linearly increased or decreased in accordance with the control of the trimming data, thereby achieving the object of trimming.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A current mode trimming apparatus for trimming a desired current, comprising:

a first transistor, wherein a current passing through the first transistor is the desired current;

a first resistor connected with the first transistor in series between a first voltage and a second voltage;

an operational amplifier, having a first input end receiving a reference voltage, a second input end electrically connected to a common node between the first resistor and the first transistor, and an output end electrically connected to a gate of the first transistor;

a first controlled current source, electrically connected between the common node and the first voltage, for providing a first current and adjusting the first current in accordance with a received first trimming data thereof; and a second controlled current source, electrically connected between the common node and the second voltage, for providing a second current and adjusting the second current in accordance with a received second trimming data thereof.

2. The current mode trimming apparatus as claimed in claim 1, wherein the first voltage is a system voltage, and the second voltage is a ground voltage.

3. The current mode trimming apparatus as claimed in claim 1, wherein the first transistor is an N-type transistor having a drain and source respectively electrically connected to the first voltage and the common node.

4. The current mode trimming apparatus as claimed in claim 1, further comprising at least one fuse unit, wherein the fuse unit outputs the first trimming data and the second trimming data in accordance with the state of fuses therein.

5. The current mode trimming apparatus as claimed in claim 4, wherein the fuse unit comprises:

a second resistor, having a first end electrically connected to the first voltage;

a third resistor, having a first end electrically connected to a second end of the second resistor;

a fuse, having a first end electrically connected to a second end of the third resistor, and a second end electrically connected to the second voltage;

a first NOT gate, having an input end electrically connected to the first end of the third resistor, and an output end outputting one bit of the first trimming data and the second trimming data; and a second NOT gate, having an input end electrically connected to the output end of the first NOT gate, and an output end outputting the another bit of the first trimming data and the second trimming data.

6. The current mode trimming apparatus as claimed in claim 5, wherein the fuse unit further comprises a pad electrically connected to the first end of the fuse.

7. The current mode trimming apparatus as claimed in claim 1, wherein the first controlled current source comprises:

n current sources $CS1_i$, for providing currents of $2^iI$ Ampere respectively, wherein $CS1_i$ represents the ith current source, where i is an integer greater than or equal to 0 but smaller than n; n is an integer greater than 0; and I is a real number; and n switches $SW1_i$, wherein the switches $SW1_i$ and the current sources $CS1_i$ are connected in series between the first voltage and the common node for determining the on/off states by themselves respectively in accordance with the first trimming data, and $SW1_i$ represents the ith switch.

8. The current mode trimming apparatus as claimed in claim 7, wherein the first trimming data has 0th bit to nth bit, and the switch $SW1_i$ comprises:

a P-type transistor $PT_i$, having a source and drain respectively electrically connected to the current source $CS1_i$ and the common node, wherein $PT_i$ represents the ith P-type transistor; and an OR gate $OR_i$, having a first input end and second input end respectively receiving the nth bit and the ith bit of the first trimming data, and an output end electrically connected to a gate of the P-type transistor $PT_i$, wherein $OR_i$ represents the ith OR gate.

9. The current mode trimming apparatus as claimed in claim 1, wherein the second controlled current source comprises:

n current sources $CS2_i$, for respectively providing currents of $2^iI$ Ampere, wherein $CS2_i$ represents the ith current source, where i is an integer greater than or equal to 0 but smaller than n; n is an integer greater than 0; and I is a real number; and n switches $SW2_i$, wherein the switches $SW2_i$ and the current sources $CS2_i$ are connected in series between the second voltage and the common node for determining the on/off states by themselves in accordance with second trimming data, and $SW2_i$ represents the ith switch.

10. The current mode trimming apparatus as claimed in claim 9, wherein the second trimming data has 0th bit to nth bit, and the switch $SW2_i$ comprises:

an N-type transistor $NT_i$, having a source and drain respectively electrically connected to the current source $CS2_i$ and the common node, wherein $NT_i$ represents the ith N-type transistor; and an AND gate $AND_i$, having a first input end and second input end respectively receiving the nth bit and the ith bit of the second trimming data, and an output end electrically connected to a gate of the N-type transistor $NT_i$, wherein $AND_i$ represents the ith AND gate.

* * * * *